United States Patent [19]

Wolbrink et al.

[11] 4,100,850

[45] Jul. 18, 1978

[54] DRIVE MECHANISM FOR TRASH COMPACTORS

[75] Inventors: David W. Wolbrink, Hartford; William A. Kaepernick, Horicon; Du Wayne M. Sellinger; Dieter W. Otte, both of Hartford, all of Wis.

[73] Assignee: Broan Manufacturing Co., Inc., Hartford, Wis.

[21] Appl. No.: 749,470

[22] Filed: Dec. 10, 1976

[51] Int. Cl.[2] ..... B30B 1/18

[52] U.S. Cl. ..... 100/287; 74/89.15; 74/424.8 R; 74/521; 85/32 K; 85/DIG. 2; 100/229 A

[58] Field of Search ..... 100/229 A, 289, 287; 49/28, 139, 199, 200, 362; 254/7 C, 85, 126, DIG. 2, DIG. 8; 318/265, 266; 74/521, 89.15, 424.8 R; 85/32 K, 32 R, DIG. 2

[56] References Cited

U.S. PATENT DOCUMENTS

| | | | |
|---|---|---|---|
| 2,561,351 | 7/1951 | Fentress | 85/DIG. 2 |
| 3,054,145 | 9/1962 | Helpa | 85/DIG. 2 |
| 3,714,890 | 2/1973 | Moon | 100/229 A |
| 3,863,561 | 2/1975 | Karls | 100/287 |
| 3,945,481 | 3/1976 | Lindberg | 74/424.8 R |
| 3,977,262 | 8/1976 | Randolph | 74/89.15 |

*Primary Examiner*—Billy J. Wilhite

*Attorney, Agent, or Firm*—Andrus, Sceales, Starke & Sawall

[57] ABSTRACT

A trash compactor has a rotatable lead screw and stationary nut for raising and lowering the compacting ram by rotation of the screw. A housing surrounds the nut for preventing rotation of the nut with respect to the screw while permitting limited pivotal movement of the nut with respect to the housing responsive to eccentric compaction forces applied to the compacting ram. The housing is distortable for the same reason and to permit absorption of shocks arising from compaction. The nut may be formed of a self-lubricating plastic. The drive mechanism may be used in a trash compactor having an extensible linkage of the scissors jack or lazy tongs type in which the lead screw is journalled in one of the intermediate junction points of the linkage. The housing containing the nut is located at the other of the junction points so that rotation of the screw extends and retracts the linkage.

24 Claims, 4 Drawing Figures

Fig. 1.
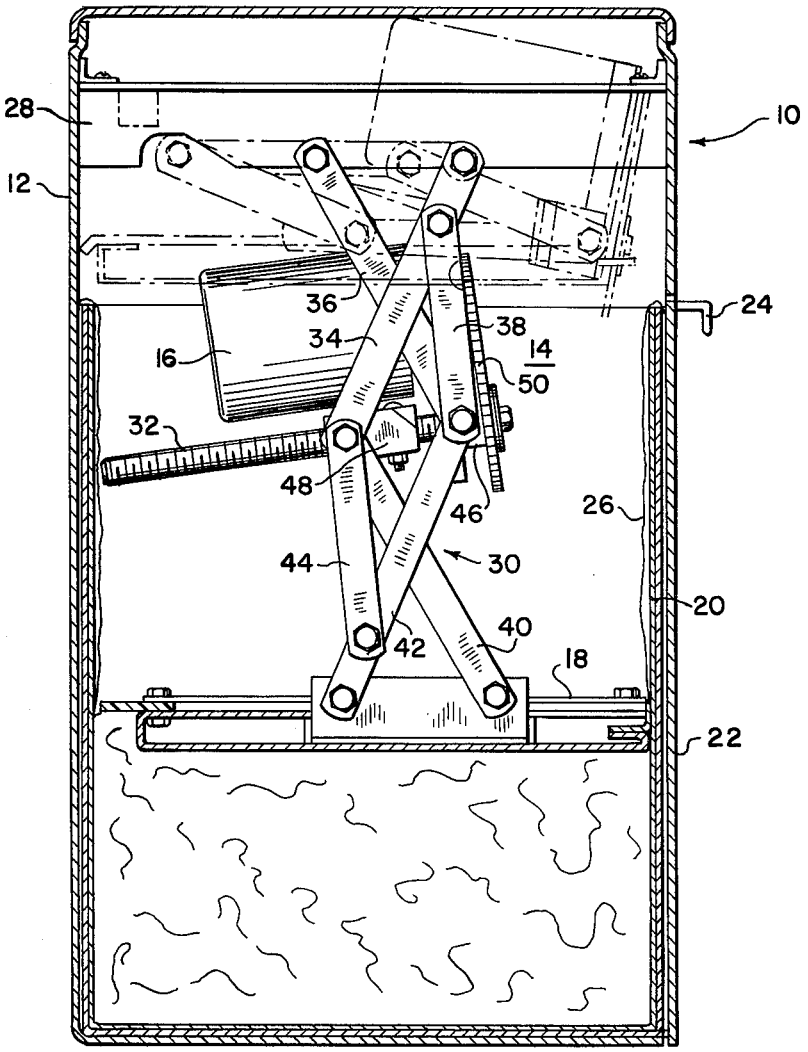
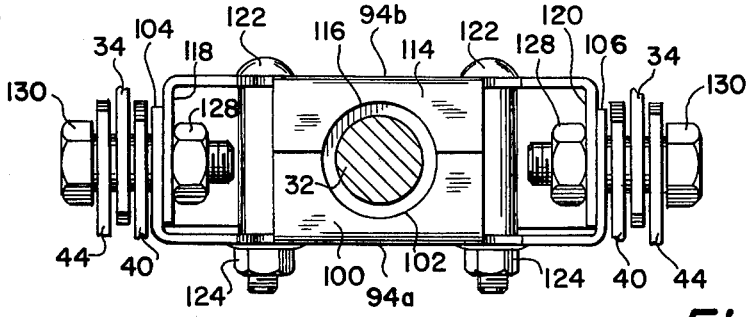
Fig. 4.

DRIVE MECHANISM FOR TRASH COMPACTORS

BACKGROUND OF THE INVENTION

1. Field of the Invention

The present invention relates to improvements in the mechanism for raising and lowering the compacting ram in a compactor.

2. Description of the Prior Art

Household trash compactors typically include a cabinet having a motor driven platen or ram mounted in the upper portion which descends into a trash containing receptacle in the lower portion of the cabinet to effect compaction. The ram then retracts to the upper portion. While many mechanisms may be employed to drive the ram, the most commonly used is of the nut and lead screw type. The nut is fastened to one of the ram or cabinet. The lead screw, which passes through the nut, is fastened to the other of ram or cabinet. The nut or lead screw is rotated, producing relative axial movement between the rotating and nonrotating elements which results in a raising or lowering of the ram.

The stresses generated during trash compaction and applied to the drive means are significant, resulting in a high level of frictional forces in the drive means. These forces tend to attain peak levels as the ram reaches the bottom of its stroke against the fully compressed trash, stops, and reverses. A large amount of power is needed to overcome the static friction appearing during the stop immediately prior to reversal and prevent the ram from becoming immobilized in the lowered position in the receptacle. These power demands may necessitate the use of a bigger motor than would otherwise be necessary.

Further, the stresses generated during trash compaction are often eccentrically applied to the drive mechanism as, for example, by a soda bottle standing in one corner of the receptacle. This causes the screw to be canted in the nut creating a wedging action which further and greatly increases the frictional drag in the drive means and the power demands on the motor.

Nut and lead screw drive mechanisms have, in the past, also produced squeals and other annoying noises during compaction. The useful life of the drive mechanism is often less than desired.

The foregoing has given rise to a variety of techniques directed toward obtaining satisfactory operation of the drive means. Lubricating greases and oils may be applied to the drive means, extending its useful life, eliminating the squeaks, and reducing frictional forces. The nut may be formed of sintered metal having a high porosity for receiving and retaining a lubricant. Or, the nut may be fabricated of cast iron having a high graphite content for the same purpose. The nut and screw may be formed so that the material of one is harder than the material of the other. Exotic materials, such as vanadium alloyed steels, may be employed in the nut. The nut may be hemispherically formed to accommodate eccentric loading of the ram and drive mechanism.

While such techniques reduced or eliminated some of the foregoing shortcomings, they often did so only to the detriment of increased cost, weight, complexity, and maintenance requirements.

SUMMARY OF THE PRESENT INVENTION

The present invention is thus directed to improvements in the drive mechanism for a trash compactor which overcomes the above failings and further enhances the construction and performance of the drive mechanism. The improvements of the present invention result in a drive mechanism which is light in weight, self-lubricating, and readily capable of resisting shocks and eccentric loading. It possesses low friction and a small variation between static friction and running friction.

The gist of the present invention is to employ, in the drive mechanism, a nut of self-lubricating plastic which is caged in a flexible housing of sheet metal to permit a limited pivoting of the nut with respect to the housing. The amount of pivoting is coordinated with the amount of eccentricity to be tolerated in the drive mechanism.

The present invention is suitable for use in a compactor having an extensible scissors jack linkage for raising and lowering the ram. In the drive means, a motor driven lead screw is mounted on one intermediate junction point while the housing, containing the nut threaded on the load screw, is connected to the other intermediate junction point The self-lubricating plastic of the nut avoids the need for applied lubricants and provides long life and silent operation to the drive means. The pivoting of the nut within the housing permits relative movement between the linkage and housing and the nut which accommodates distortion in the linkage arising from eccentric loading of the ram or otherwise without binding the nut on the screw. The corners of the nut may be beveled to provide the pivoting. The flexibility of the housing similarly accommodates shocks and distortion in the linkage while reducing the weight of the drive mechanism. The self-lubricating properties of the plastic in conjunction with the pivotal mounting in the flexible housing reduce the friction drag on the motor. The difference between static friction and running friction is also diminished, reducing the power demands on the motor in reversing the ram at the bottom of its stroke.

BRIEF DESCRIPTION OF THE DRAWING

FIG. 1 is a cross sectional, elevational view of a trash compactor with which the drive mechanism improvement of the present invention may be employed.

FIG. 4 is a rear view of an element of the improved drive mechanism of the present invention taken along the line 4—4 of FIG. 3.

DETAILED DESCRIPTION OF THE PREFERRED EMBODIMENT

Figure 2:
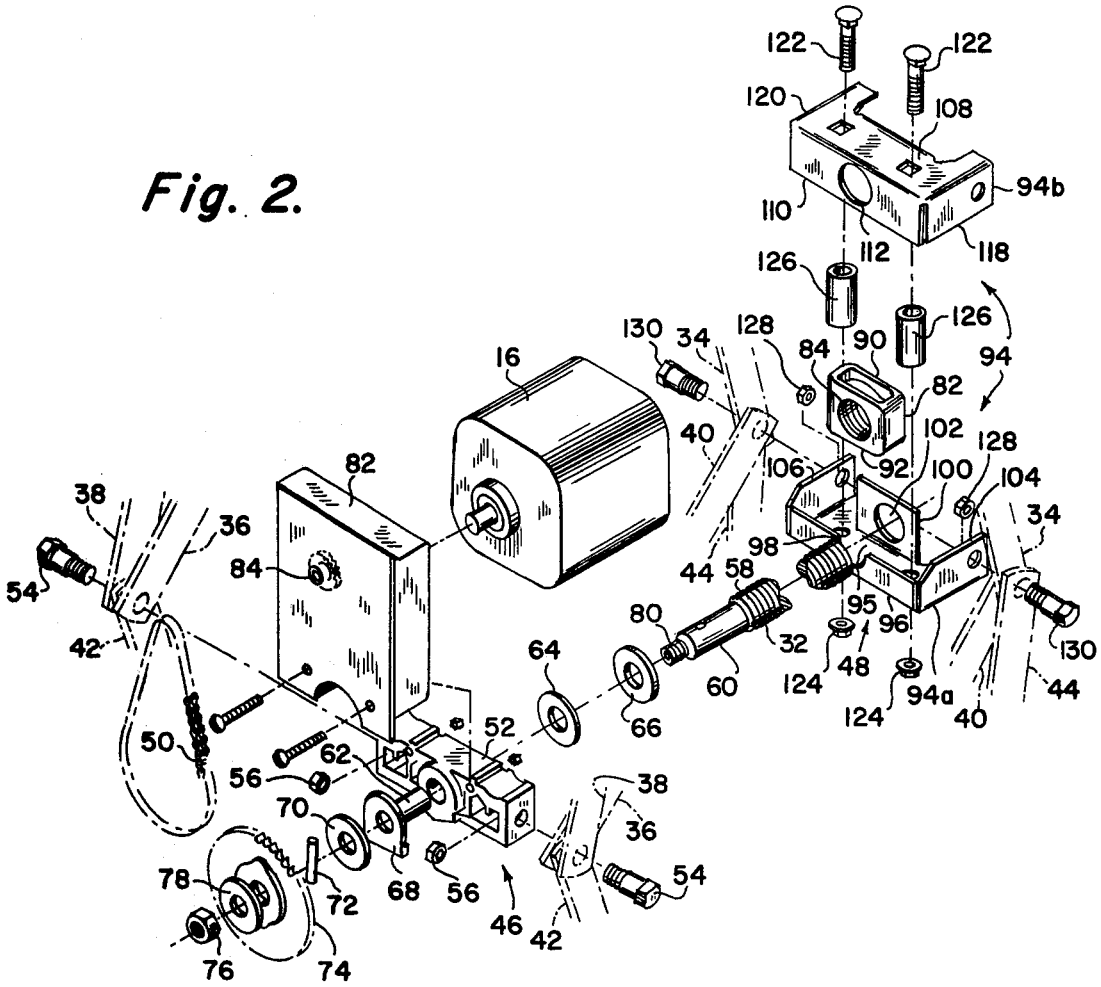
FIG. 2 is an exploded detailed view of the drive mechanism improvements of the present invention.

Turning now to the Figures, there is shown in FIG. 1 a trash compactor identified by the numeral 10. Compactor 10 is of the type disclosed in U.S. Pat. No. 3,714,890 to Jerry W. Moon. Trash compactor 10 typically includes cabinet 12 containing compacting mechanism 14 in the upper portions thereof. Compacting mechanism 14 is powered by motor 16, in a manner hereinafter described, to raise and lower compacting platen or ram 18. Receptacle 20 for receiving the trash to be compacted is positioned in the lower portion of cabinet 12. Receptacle 20 may be positioned in a drawer 22 which is slidable out of compactor 10 by grasping handle 24 to permit trash to be deposited in receptacle 20 and to dispose of the compacted trash. Receptacle 20 may be lined with bag 26, if desired.

In the event the trash compactor is designed as a built-in unit, as for example, under a kitchen counter, cabinet 12 may be eliminated. Compactor 10 is provided with a framework which positions the elements of the compactor and which includes an exposed front wall containing the drawer 22 for receptacle 20.

Compacting mechanism 14 may be suspended in cabinet 12 by a pair of transverse beams, one of which is shown as 28 in FIG. 1. Beams 28 are spaced horizontally apart to permit nesting of motor 16 and compacting mechanism 14 when the same is in the retracted position, as shown in broken lines in FIG. 1.

As disclosed in the aforesaid Moon patent, the compacting mechanism includes a pair of laterally spaced extensible linkages, one of which is shown as 30 in FIG. 1. Each of the sets of linkages consists of two identical five-bar linkages in which the fifth bar consists of a variable length element which is common to both of the five-bar linkages. As hereinafter described in detail, the variable length element comprises threaded lead screw 32. The upper five-bar linkage consists of beam 28, two cross links 34 and 36, stabilizer link 38 and screw 32. The lower five-bar linkage similarly consists of screw 32, two cross links 40 and 42, stabilizer link 44 and ram 18. Lead screw 32 is journalled in a trunnion 46, hereinafter termed the front trunnion connected to the ends of links 36 and 42. Rear trunnion 48 contains a nut, shown in detail in FIGS. 2 and 3, threaded on lead screw 32. Rear trunnion 48 is connected to the ends of links 34 and 40.

When lead screw 32 is rotated in one direction by motor 16 through chain 50. rear trunnion 48 is moved along lead screw 32 toward front trunnion 46 to the position shown in FIG. 1 to lower ram 18 along a generally vertical compaction axis. When lead screw 32 is rotated in the opposite direction, rear trunnion 48 is moved away from front trunnion 46 to contract linkage 30 and move ram 18 to the raised position, as shown in dotted lines in FIG. 1.

Figure 3:
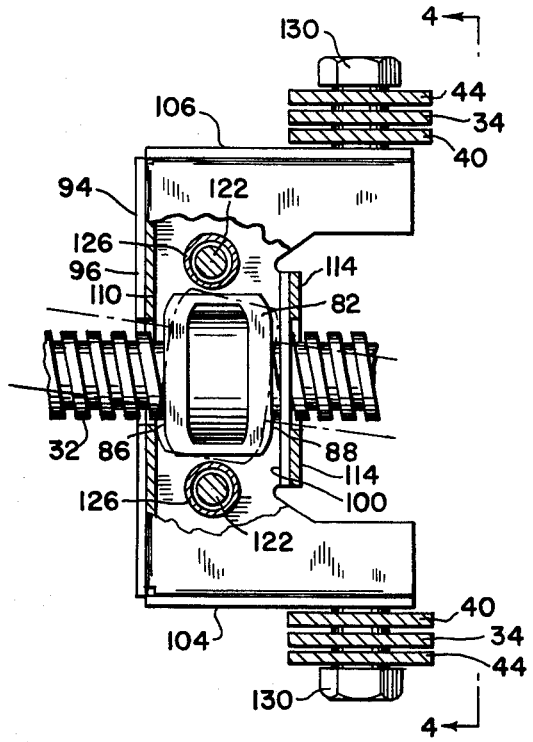
FIG. 3 is a partially cut away plan view of an element of the improved drive mechanism of the present invention.

The details of the drive mechanism improvement of the present invention are shown in FIGS. 2 and 3. Front trunnion 46 includes bar 52, the ends of which abut links 36 and 42 of each of the sets of linkages. The linkages are rotatably retained on the ends of bar 52 by bolts 54 and nuts 56.

Lead screw 32 includes a threaded portion 58. The thread on portion 58 is preferably of a type which minimizes friction between lead screw 32 and the nut. A screw having the generally rectangular thread configuration, known as an Acme thread, may be employed for this purpose. Lead screw 32 also includes bearing portion 60 journalled in front trunnion 46. For this purpose, a sleeve bearing 62 fits in a hole in bar 52 to receive portion 60 of lead screw 32. Thrust washers 64 and 66 may be positioned on screw 32 along the side of bar 52 facing threads 58. Bearing 62 includes face 68 which abuts bar 52 and thrust washer 70.

The end of lead screw 32 extending through bar 52 contains a hole for receiving pin 72, the ends of which extend beyond the periphery of bearing portion 60 to mate with a slot in the rear of gear 74. The front trunnion assembly is retained in the assembled condition by nut 76 and washer 78 mounted on the threaded end 80 of lead screw 32.

Gear box 82 is mounted on bar 52. Drive chain 50 extends from spur gear 84 in gear box 82 to gear 74 on lead screw 32. Motor 16 is mounted on gear box 82 so as to be positioned generally above lead screw 32 as shown in FIG. 1.

The salient features of the invention reside in the construction and form of rear trunnion 50 containing nut 82. Nut 82 is formed of a generally rectangular configuration having a threaded hole 84 for mating with lead screw 32. Hole 84 extends between a pair of parallel faces 86 and 88. (See FIG. 3) Nut 82 also includes upper and lower surfaces 90 and 92, as shown in FIG. 2.

Rear trunnion 48 includes a housing 94 for receiving nut 82 and for restraining the nut from rotation with lead screw 32. The housing also permits limited pivotal movement of nut 82 with respect to housing 94 and provides flexural properties which permit the absorption of shocks and eccentric loading on linkage 14.

Housing 94 is preferably formed of sheet metal to reduce the weight of the trunnion and to provide the aforesaid elastic properties. Housing 94 has lower and upper halves **94*a* and 94*b*. As shown in FIG. 3, housing 94 is generally U-shaped in configuration having a portion lying normal to lead screw 32 and a pair of arms extending parallel to lead screw 32. The U-shape to housing 94 permits the juncture of links 34 and 44 to be positioned at the end of lead screw 32 when the linkage is in the retracted condition while at the same time insuring that nut 82 does not inadvertantly become unthreaded from lead screw 32**.

The lower portion **94*a* of housing 94 includes generally U-shaped base 95. Base 95 supports a forward upturned flange 96 having a semi-circular cut-out 98 through which lead screw 32 may extend. A rear upturned flange 100 includes a hole 102 through which lead screw 32 may extend. Flanges 104 and 106 are provided along either side of base 95 parallel to lead screw 32**.

Upper portion **94*b* contains a generally U-shaped base 108. A front flange 110 depends from the forward edge of base 108 to contain hole 112. A depending rear flange 114, see FIG. 4, contains semi-circular groove 116. Side flanges 118 and 120 depend from the arms extending from base member 108**.

To assemble rear trunnion 50, nut 82 is placed on base 95 of lower half **94*a* of the trunnion. The upper half is placed on top of nut 82 so that front flange 96 of lower half 94*a* overlaps the front surface of front flange 110 of upper half 94*b*. Rear flange 114 of upper half 94*b* overlaps the rear surface of rear flange 100 of lower half 94*a*. Depending side flanges 118 and 120 of upper half 94*b* fit inside flanges 104 and 106 of lower half 94*a***.

Bolts 122 extend through upper and lower halves **94*a* and 94*b* and are fastened by nuts 124. Spacers 126 surround bolts 122 to limit the amount by which upper half and lower half 94*a* and 94*b* may be drawn together. The length of spacers 126 is such that nut 82 is loosely retained in housing 94 but is restrained from rotating with respect to the housing by the contact of surfaces 90 and 92 with the surfaces of base 95 of lower half 94*a* and base 108 of upper half 94*b*. Links 34, 40, and 44 are fastened to the exterior of lower half 94*a* by nuts 128 and bolts 130**.

As shown most clearly in FIG. 3, the vertical corners of nut 82 may be beveled. This allows the nut to pivot in the horizontal direction with respect to housing 94, as shown in phantom in FIG. 3, during deflection of the drive mechanism caused by unbalanced loads and/or shocks applied to ram 18. This pivotal movement prevents increases in friction in the drive mechanism resulting from such loading of ram 18. The amount of such beveling determines the amount by which the nut may pivot and the amount of deflection in the linkage and drive mechanism which may be accommodated. At present beveling which permits nut 82 to pivot between 4° and 10°, for example 7°, is deemed preferable. For this purpose the surfaces of contact of the beveled corners of nut 82 with the inside of housing 94 may lie at a similar angle, for example 7°, to the plane of faces 86 and 88.

Nut 82 is preferably formed from a self-lubricating plastic. Excellent results have been found using the polyformaldehyde plastic commonly sold under the trade name "Delrin". Such plastic does not require lubrication for operation although application of a small amount of lubricant facilitates break in. It provides long life and silent running to the drive mechanism and possess high tensile strength, good moldability, and high moisture and chemical resistance. The resiliency of the material also assists in accommodating distortion in the linkage. Polyamides or polyesters may also be used to form nut 82.

The static friction of the foregoing types of plastics and particularly the polyformaldehyde plastic is less than that for other materials from which lead screw nuts have been fabricated and more nearly approximates the running friction. This eliminates or substantially lessens the likelihood of the ram becoming immobilized in the receptacle.

Various modes of carrying out the invention are contemplated as being within the scope of the following claims particularly pointing out and distinctly claiming the subject matter which is regarded as the invention.

We claim:

1. A trash compactor having a ram movable in a frame into and out of a compaction position by means of a lead screw coupled to one of said ram or frame, said ram being subject to eccentric loading which alters the position of the screw, the improvement comprising;

a nut threaded on the lead screw for axial movement along the lead screw responsive to relative rotation between said screw and nut, said nut having opposing faces through which said screw extends, and a housing surrounding said nut for providing said relative rotation between said nut and screw, said housing having a pair of walls lying generally normal to the lead screw and loosely embracing said nut along said faces for permitting relative pivotal movement of said nut with respect to said housing about an axis generally normal to the lead screw, the faces of said nut having corners which abut said walls during said relative pivotal movement, said corners being beveled to facilitate said movement and to limit the movement to that necessary to accommodate a limited range of alterations in the position of the screw, said housing being coupled to the other of said ram or frame for providing movement to the ram responsive to relative rotation between the nut and screw.

2. The improvement according to claim 1 wherein said nut has a pair of surfaces on opposite sides of said screw and said housing has a mating pair of surfaces for restraining said nut from rotation.

3. The improvement according to claim 2 wherein said housing includes means for positioning the surfaces of said housing contiguous with the surfaces of said nut for restraining said nut from rotation while permitting said relative pivotal movement.

4. The improvement according to claim 1 wherein said corners are beveled by an amount sufficient to permit a relative pivotal movement of between 4° and 10°.

5. The improvement according to claim 4 wherein said corners are beveled by an amount sufficient to permit a relative pivotal movement of approximately 7°.

6. The improvement according to claim 1 wherein said housing is formed of an elastically distortable material for accommodating distortion resulting from eccentric loading of the ram.

7. The housing according to claim 6 wherein said housing is fabricated out of a sheet material formed to embrace said nut.

8. The improvement according to claim 7 wherein said nut is formed of a self-lubricating plastic.

9. The improvement according to claim 8 wherein said nut is formed from a material class including polyformaldehyde, polyamide, and polyester resins.

10. The improvement according to claim 9 wherein said nut is formed of a polyformaldehyde resin.

11. The improvement according to claim 6 wherein said housing is formed of a flexible material.

12. In a trash compactor having an extensible linkage for moving a ram along a compaction axis into and out of a compaction position, said linkage being extensible along the compaction axis by the movement of first and second linkage junction points toward and away from each other in a direction generally normal to the compaction axis, said compactor having a lead screw rotatable journalled at one of the junction points, the improvement comprising:

a nut located at the other of the junction points and threaded on the lead screw for axial movement along the lead screw responsive to rotation of said screw, said nut having opposing faces through which said screw extends and a housing surrounding said nut for restraining said nut from rotation with the lead screw, said housing having a pair of walls lying generally normal to said lead screw and loosely embracing said nut along said faces for permitting relative pivotal movement of said nut with respect to said housing about an axis generally normal to the lead screw, the faces of said nut having corners which abut said walls during said relative pivotal movement, said corners being beveled to facilitate said movement, said housing being coupled to the second junction point for providing the toward and away movement of the junction points responsive to rotation of the screw.

13. The improvement according to claim 12 wherein said nut has a pair of surfaces on opposite sides of said screw and said housing has a mating pair of surfaces for restraining said nut from rotation.

14. The improvement according to claim 13 wherein said housing includes means for positioning the surfaces of said housing contiguous with the surfaces of said nut for restraining said nut from rotation while permitting said relative pivotal movement.

15. The improvement according to claim 12 wherein the ram is subject to eccentric loading which alters the position of the screw, and wherein said nut and housing are formed such that the loose embrace of said nut by said housing and the bevelling of said corners permits a limited relative pivotal movement for accommodating a limited range of alterations in the position of the screw.

16. The improvement according to claim 12 wherein said corners are beveled by an amount sufficient to permit a relative pivotal movement of between 4° and 10°.

17. The improvement of the claim 16 wherein said corners are beveled by an amount sufficient to permit a relative pivotal movement of approximately 7°.

18. The improvement according to claim 15 wherein said housing is formed of an elastically distortable material for accommodating distortion in the linkage from eccentric loading of the ram.

19. The improvement according to claim 18 wherein said housing is formed of a flexible material.

20. The housing according to claim 19 wherein said housing is fabricated out of a sheet material formed to embrace said nut.

21. The improvement according to claim 20 wherein said nut is formed of a self-lubricating plastic.

22. The improvement according to claim 21 wherein said nut is formed from a material class including polyformaldehyde, polyamide, and polyester resins.

23. The improvement according to claim 22 wherein said nut is formed of a polyformaldehyde resin.

24. The improvement according to claim 20 wherein the one of said junction points includes a bearing formed of a self-lubricating plastic for journalling the lead screw.

* * * * *